United States Patent [19]

Dials et al.

[11] 4,350,452

[45] Sep. 21, 1982

[54] RIBBON LOADING SYSTEM FOR A TYPEWRITER OR THE LIKE USING A SIDEMOUNTED RIBBON CARTRIDGE HAVING A DETACHABLE RIBBON GUIDE

[75] Inventors: Edward N. Dials, Versailles; Drew A. Kightlinger, Lexington, both of Ky.

[73] Assignee: International Business Machines Corporation, Armonk, N.Y.

[21] Appl. No.: 136,003

[22] Filed: Mar. 31, 1980

[51] Int. Cl.[3] ..... B41J 33/14

[52] U.S. Cl. ..... 400/208; 400/229; 400/233; 400/234; 400/248

[58] Field of Search ..... 400/120, 171, 194, 195, 400/196, 196.1, 207, 208, 208.1, 229, 233, 234, 248

[56] References Cited

U.S. PATENT DOCUMENTS

| | | | |
|---|---|---|---|
| 2,062,455 | 12/1936 | Henry | 40/248 X |
| 2,165,739 | 7/1939 | Verkinderen | 400/208.1 X |
| 2,803,331 | 8/1957 | Berill | 400/248 X |
| 2,873,015 | 2/1959 | Gray | 400/208.1 |
| 2,889,908 | 6/1959 | Korner | 400/234 X |
| 3,211,273 | 10/1965 | Bishop | 400/208.1 |
| 3,272,304 | 9/1966 | Morelli | 400/208.1 |
| 3,285,383 | 11/1966 | Landgraf | 400/208.1 X |
| 3,643,778 | 2/1972 | Anderson | 400/208 |
| 3,645,372 | 2/1972 | Noell et al. | 400/171 |
| 3,726,381 | 4/1973 | Murphy | 400/196.1 |
| 3,777,871 | 12/1973 | Zeamer | 400/208 |
| 3,855,448 | 12/1974 | Hanagata et al. | 400/120 X |
| 3,889,795 | 6/1975 | Garberi et al. | 400/208 |
| 3,899,065 | 8/1975 | Brignole | 400/248 X |
| 3,941,231 | 3/1976 | Matuck et al. | 400/196.1 |
| 3,977,511 | 8/1976 | Hengelhaupt | 400/207 X |
| 3,980,171 | 9/1976 | Frechette | 400/208 |
| 4,046,247 | 9/1977 | Laspesa et al. | 400/196 |
| 4,047,607 | 9/1977 | Willcox | 400/208 |
| 4,047,608 | 9/1977 | Willcox | 400/208 |
| 4,074,799 | 2/1978 | Hishida et al. | 400/234 X |
| 4,091,914 | 5/1978 | Stipanuk | 400/196.1 |
| 4,157,224 | 6/1979 | Purzycki et al. | 400/196 X |
| 4,175,877 | 11/1979 | Randolph | 400/196 |
| 4,213,715 | 7/1980 | Haftmann et al. | 400/196.1 |

FOREIGN PATENT DOCUMENTS

| | | | |
|---|---|---|---|
| 55-142688 | 11/1980 | Japan | 400/196.1 |

OTHER PUBLICATIONS

IBM Technical Disclosure Bulletin, "Print Mechanism Ribbon Feed", Bernard, vol. 7, No. 3, Aug. 1964, pp. 250–251.

IBM Technical Disclosure Bulletin, "Ribbon Drive", Cross, vol. 15, No. 7, Dec. 1972, p. 2312.

IBM Technical Disclosure Bulletin, "Carrier Driven Ribbon Feed for Typewriter", Dials et al., vol. 22, No. 12, May 1980, p. 5397.

*Primary Examiner*—Ernest T. Wright, Jr.

*Attorney, Agent, or Firm*—George E. Grosser

[57] ABSTRACT

A ribbon loading system for a printer of the kind having a moveable printhead carrier establishes a ribbon loading position for the carrier at one end of the carrier travel axis. In response to an operator initiation, the printhead carrier is driven to the loading position where the ribbon cartridge is operator mounted at a fixture adjacent the printhead. The cartridge includes a path defining section that extends to arrange a loop of ribbon around the distal side of the printhead, effectively threading the ribbon. Subsequent carrier movement is selectively coupled to the ribbon to provide ribbon drive motion.

For a preferred cartridge implementation, the path defining section is detachable to travel with the printhead carrier and includes ribbon guides for defining at least a portion of the ribbon path around the printhead during printing. The preferred detachable section is held to a bulk ribbon supply section of the cartridge by a catch which is automatically released by mounting the cartridge. For the mounting and removal operations, which involve the operator, the preferred two section cartridge is connected for convenient handling as a unit.

4 Claims, 10 Drawing Figures

RIBBON LOADING SYSTEM FOR A TYPEWRITER OR THE LIKE USING A SIDEMOUNTED RIBBON CARTRIDGE HAVING A DETACHABLE RIBBON GUIDE

BRIEF SUMMARY OF THE INVENTION

1. Field of the Invention

The invention relates to ribbon systems for printers and more particularly to ribbon systems for printers having a printhead that moves on a carrier along a printing axis.

2. Art Discussion

It is known to supply ribbon to a moving printhead type of printer using a stationary (frame mounted) bulk ribbon supply and ribbon takeup (see, e.g., U.S. Pat. No. 3,855,448 at FIG. 5). These "off-carrier" ribbon feeds, however, generally require the operator to perform a rather involved threading process because the bulk supplies must be located so as not to interfere with the travel of the printhead carrier. For an interactive printer such as a typewriter, it is desirable for the operator to view the text as it is printed and the ribbon accordingly must be directed away from the print receiving medium on the trailing side of the printhead (trailing in relation to forward printing movement).

One known approach (see, e.g., U.S. Pat. No. 3,726,381) to off-carriage ribbon feed locates the bulk supply and takeup beneath the carriage using a cartridge that extends the length of the print axis. Such a long cartridge tends to be unwieldy, however, and some ribbon handling by the operator is required to place the ribbon around the printhead.

Another known approach to off-carrier ribbon feed (see, e.g., U.S. Pat. No. 4,047,607) uses a cartridge located in front of the printhead (away from the receiving medium) with the ribbon being directed to the carrier by an articulated arm extending from the cartridge. To load the ribbon, the operator connects the free end of the arm to the carrier and loops the ribbon around the printhead. Another arrangement using a cartridge in front of the printhead carrier is described in U.S. Pat. No. 4,047,608. A flexible band extends in a loop from the cartridge and is clamped at one point to the carriage to serve as a ribbon guide. Such an arrangement, however, tends to have a high friction drag because of ribbon contact with the band.

A technique is described in U.S. Pat. No. 2,873,015 that eliminates operator threading by providing a center section of a cartridge that mounts in the ribbon vibrator. Supply and takeup sections are then separated and are placed on respective holders to either side of the printing station by the operator.

SUMMARY OF THE INVENTION

For a printer of the kind having a printhead on a carrier that is moveable along a path of travel between two terminal positions, a ribbon cartridge holder is located adjacent one terminal position that is identified as a ribbon loading position for the carrier. By so arranging the holder and carrier for cartridge loading, an unchanging close-spaced configuration is achieved for loading and threading the ribbon. And, a ribbon cartridge is, according to the invention, customized with a frame that extends to thread a loop of ribbon around the printhead for such configuration.

For a preferred implementation, a cartridge is provided with a bulk ribbon storage section and a detachable section that moves with the carrier and defines at least a portion of the ribbon path around the printhead during printing. With this arrangement, the ribbon is protected from contact when the cartridge is in the attached configuration. Preferably, the detachable section is latched to the storage section by a catch that is automatically released as a part of the mounting operation of the cartridge holder and is reactivated by removal from the cartridge holder.

A further benefit of such an off-carrier cartridge arrangement is that carrier motion may be used to conveniently draw out a section of ribbon along the printing line and, preferably, the ribbon loading terminal is in the direction of forward printing so that the ribbon loop extends over the area to be printed but leaves the portion of a printing line already scanned by the printhead unobscured. Carrier motion may also be conveniently employed to selectively drive the ribbon to a takeup device as printing is effected, preferably using a cable-pulley connection to the carrier with unidirectional clutches being included on the transmission path.

BRIEF DESCRIPTION OF THE DRAWING

The invention will be described in detail with reference to the drawing wherein.

DETAILED DESCRIPTION OF THE DRAWINGS

Figure 1:
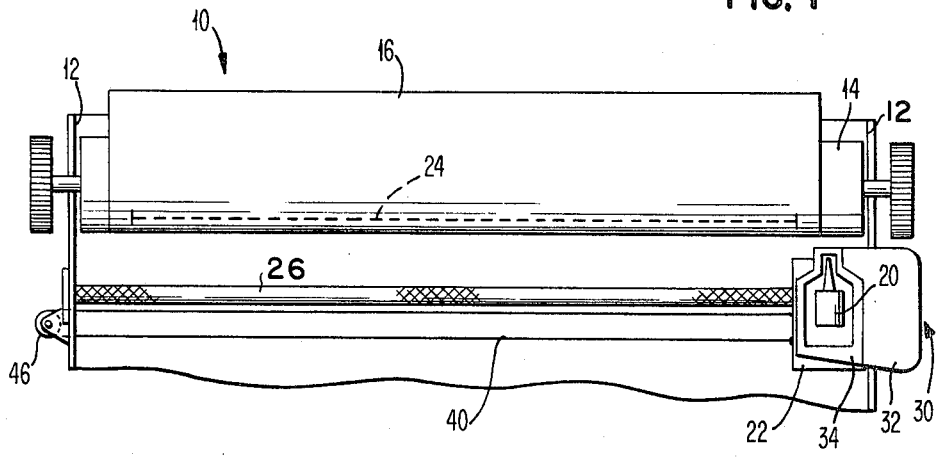
FIG. 1 is a simplified plan view of a printer having a ribbon loading position according to the invention.

Referring to FIG. 1, a printer 10 implementing the invention includes a printer frame 12 supporting a platen 14 which in cooperation with feed rollers (not shown) defines a path for a receiving medium 16 such as a sheet of paper. Printing is performed by a printhead 20, which may be of various known types, for example, a ballistic wire printhead. A carrier 22 supports the printhead 20 for movement along a carrier travel path so as to define a printing line 24 that is preferably parallel to the longitudinal axis of platen 14. Movement of the carrier 22 along the printing axis is controlled by carrier positioning means such as a leadscrew 26 and associated drive apparatus (not shown) as is well known in the art.

A ribbon loading position is established for the carrier 22 at an end of the carrier travel path, preferably, the end in the forward printing direction. At the ribbon loading position, a cartridge 30 for supplying the ribbon 36 is mountable to provide an "off-carrier" ribbon supply/takeup and to establish a ribbon path around the printhead 20 as will be discussed in more detail below.

Figure 2:
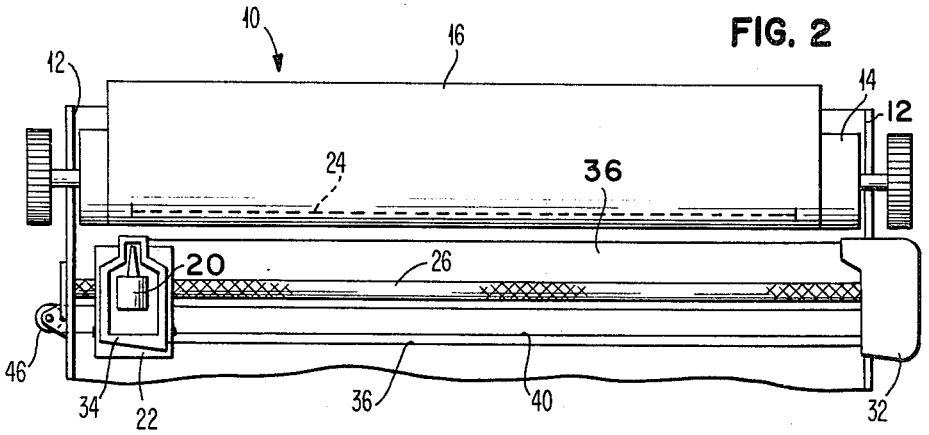
FIG. 2 is a simplified plan view of a printer which emphasizes a detachable cartridge according to the invention.
Figure 3:
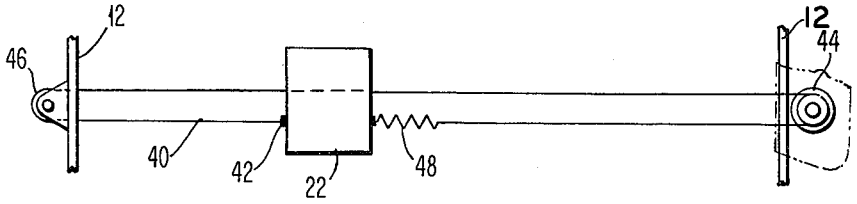
FIG. 3 is a simplified plan view of a cable connection for driving a ribbon feeder using motion from a printhead carrier.

For the presently preferred implementation, the cartridge 30 comprises a first section 32 that remains at the loading position until removed by the operator and a second section 34 that defines a portion of the path for the ribbon 36 and detaches to move with carrier 22 (see FIG. 2). A preferred arrangement for driving the ribbon 36 (see FIG. 3) utilizes a cable 40 that is attached to the carrier 22 at one end 42 and extends around pulleys 44 and 46. The other end of the cable 40 attaches through a tension spring 48 to the carrier 22. The preferred mechanism for selectively transmitting motion from the pulley 44 to the ribbon 36 is discussed below.

Figure 5:
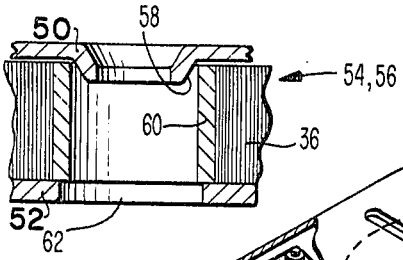
FIG. 5 is a cross sectional view, taken along section line 5—5 as indicated in FIG. 4, for emphasizing ribbon reel locating and accessing features of the presently preferred cartridge.
Figure 4:
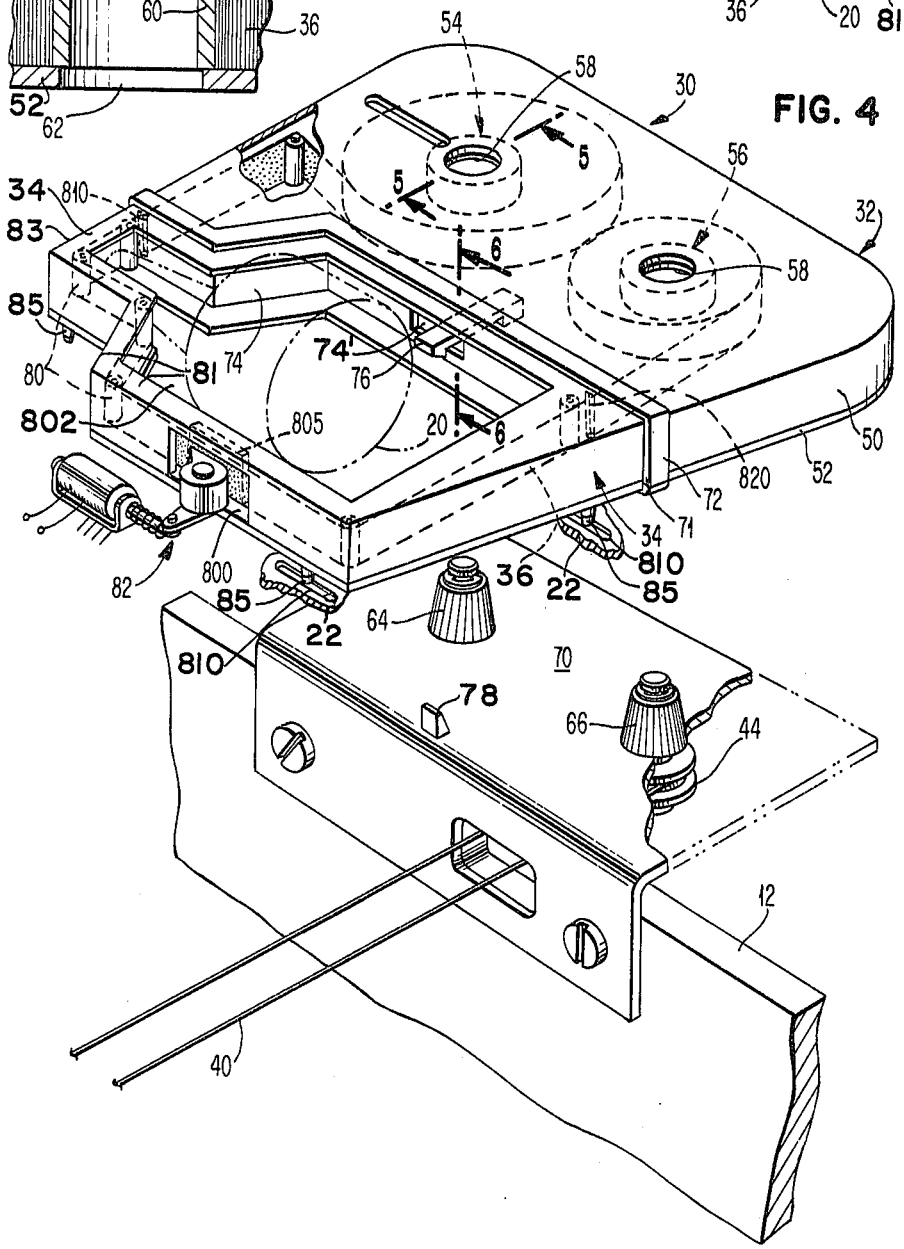
FIG. 4 is a perspective view of a presently preferred ribbon cartridge and cooperating holder.

Now referring to FIG. 4, the first section 32 preferably comprises attached top and bottom covers 50 and 52 that enclose a supply reel 54 of ribbon 36 and a takeup reel 56 of ribbon 36. Coarse positioning of the reels 54 and 56 within section 32 is achieved by respective depressions 58 (see FIG. 5) in top cover 50 that engage hollow reel cores 60. Respective apertures are defined by edges 62 to receive a set of reel couplers 64 and 66 which engage the reel cores 60. The reel couplers 64 and 66 are spaced apart on a cartridge mounting bracket or holder 70 that is attached to the printer frame 12 and a corresponding spacing is established for reels 54 and 56. By engaging the reel cores 60, the couplers 64 and 66 serve to locate and to retain the section 32 on the holder 70.

Figure 6:
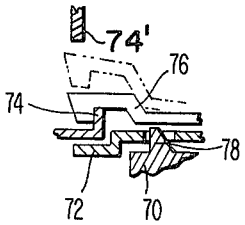
FIG. 6 is a cross-sectional view, taken at section line 6—6 of FIG. 4 for emphasizing a displaceable catch.

A side 71 of the first section 32 that faces the carrier 22 has a portion such as a lip 72 which couples to an opposing side 74 of the second section 34. Attachment of sections 32 and 34 to act as a unit is maintained by retaining means such as a catch 76 that hooks the side 74 through an aperture 74' formed therein (see FIGS. 4 and 6). Release of the catch 76 to permit detachment of sections 32 and 34 is effected by a projection 78 extending from the holder 70. The location of projection 78 relative to reel couplers 64 and 66 corresponds to the position of the catch 76 relative to the reels 54 and 56. With the cartridge 30 mounted, the projection 78 extends through bottom cover 52 to displace the catch 76 (see dashed lines in FIG. 6).

According to the preferred implementation for the invention, second section 34 includes a set of ribbon path defining guides such as rollers 80 that are mounted in a guide frame 81 that defines a central opening 802 for receiving the printhead 20. A loop of ribbon 36 extends through openings (openings 810, 820 and the opening defined by the lip 72) in the opposing sides 71 and 74 of sections 32 and 34 and along the path defined by rollers 80.

As an alternative for using the same general loading approach, a modified cartridge 30 may be employed having a frame 81 that is open at the end facing the opposite carrier path terminal so as to permit egress of the printhead 20. Using the modified cartridge 30, one or more of the rollers 80 are mounted on the carrier 22 to capture the ribbon 36 as the printhead 20 departs the ribbon loading position and, since the printhead 20 is not blocked by the guide frame 81, no cartridge separation would be required.

For the ribbon load position of the carrier 22 (see also FIG. 1), the second section 34 accommodates the printhead 20 while still being attached to the first section 32 which is configured to receive reel couplers 64 and 66 at the holder 70. Hence, the operator is enabled to load the cartridge 30 as a unit, without touching the ribbon 36. Preferably, guide frame 81 is formed as a three sided channel (in cross section) to protect the ribbon 36 from contact.

Figure 7:
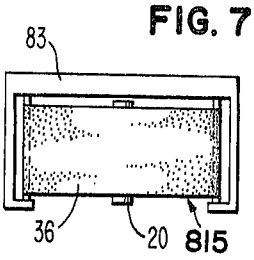
FIG. 7 is a partial end view emphasizing a ribbon access opening for a printhead.

An aperture 815 is defined at a side 83 of the second section 34 that faces the printing line 24 (see FIG. 7) to allow the printhead 20 to operatively engage the ribbon 36. A further aperture 800 is preferably defined in the second section 34 to permit engagement of the ribbon 36 by a signal-actuated ribbon clamp 82 that works against a tab 805 that may be a part of the guide frame 81 or mounted to carrier 22 to control ribbon advance as is discussed below. A plurality of pins 85 molded onto the guide frame 81 serve to locate and retain the second section 34 by cooperating in correspondingly positioned slots 810 of carrier 22 (see FIG. 4).

Figure 8:
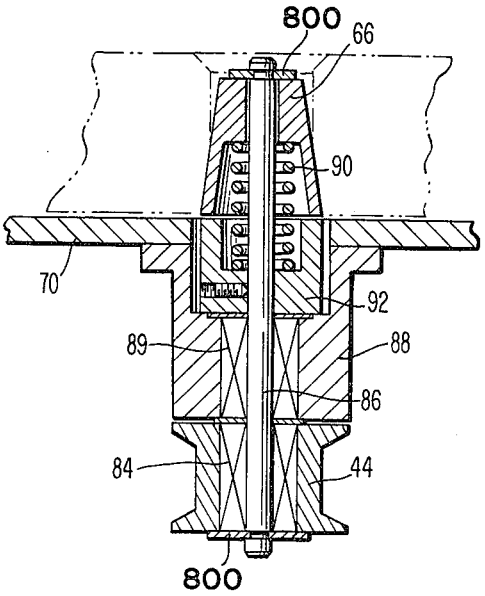
FIG. 8 is a cross-sectional view of a carrier motion transmitting system.

Referring to FIG. 8, the transmission path for motion from the pulley 44 to the reel coupler 66 includes a unidirectional clutch 84 (e.g. a Torrington bearing) to couple forward printing motion of the carrier 22 to a shaft 86 that is held in place by fasteners such as c-clips 800 at either end. Reverse motion of the carrier 22 is not transmittable through the unidirectional clutch 84 which merely slips for such motion. A mounting fixture 88 through which the shaft 86 passes is rigidly attached to the holder 70. Only relative rotation of the shaft 86 in the direction corresponding to forward carrier motion is possible because of the action of a unidirectional clutch 89 that is located within the fixture 88.

Motion transmission between the shaft 86 and the reel coupler 66 is controlled by a clutch spring 90 that cooperates with a cupped member 92 to provide torque-limited friction drive operation. The cupped member 92 is keyed to rotate with shaft 86 and the spring 90 transmits motion by friction coupling to reel coupler 66 up to a torque level at which slippage occurs. A similar friction clutch arrangement using a clutch spring (not shown) is used in mounting reel coupler 64 to holder 70.

In operation, forward motion of the carrier 22 is coupled through the pulley 44 and the clutch 84 to shaft 86. The pulley 44 is sized to overdrive the shaft 86 so that slippage of the clutch spring 90 generally occurs to maintain a rather uniform tension in driving the ribbon 36 for effecting ribbon takeup. For reverse motion of the carrier 22, the ribbon clamp 82 is actuated to cause the ribbon 36 to be drawn from both the reels 54 and 56 against the frictional resistance produced by the clutch spring (e.g. spring 90) rubbing against the reel couplers 64 and 66.

Figure 9:
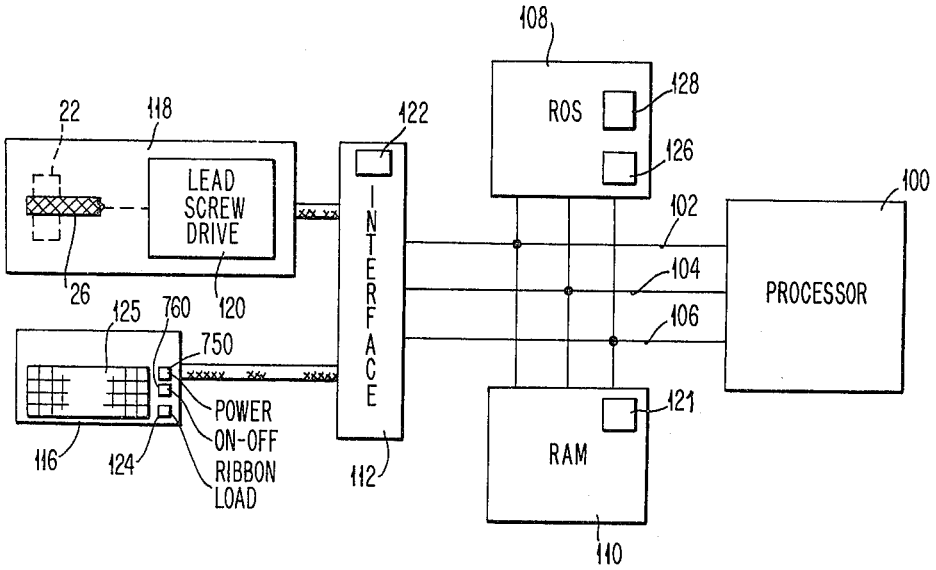
FIG. 9 is a schematic diagram indicating a logic control for a typewriter.

Referring to FIG. 9, a typewriter control configuration includes a processor 100 that is coupled through address, data, and control channels 102, 104 and 106 to a read only storage (ROS) 108, a read/write storage (RAM) 110, and an interface device 112. This control configuration is similar to that of the IBM Electronic Typewriter Model 75.

Signals to and from a keyboard apparatus 116 and printing apparatus 118 are communicated to the processor 100 through the interface device 112. Of particular interest for the present invention is logic for driving the carrier 22 to the ribbon load position.

Using a carrier positioning system that provides carrier displacement indicative pulses (e.g. emitter pulses)

from a drive 120, as is well known, a number (CP) representative of the present position of printhead carrier 22 is maintained at a location 121 in the RAM 110. To shift the position of the carrier 22, a shift distance representative number ($\Delta X$) is transmitted to a counter register 122 in the interface device 112. The interface device 112 then signals the drive 120 to move the carrier 22 in the desired direction. As the carrier 22 moves signals indicative of movement are fed back to the interface device 112 which adjusts the shift distance total at counter register 122 accordingly. When the total at counter register 122 is reduced to zero, the signal from the interface device 112 to drive 120 is removed. Typically, the number CP at location 121 is updated before sending the number $\Delta X$ to counter register 122. It should be appreciated, however, that this is only one of many well known techniques for controlling the position of a carrier such as the printhead carrier 22.

For a presently preferred ribbon loading control according to the invention, an operator actuated "load" switch 124 is added to a set of keys 125 of the keyboard apparatus 116. A number representing the load position along the carrier travel path is permanently defined by a storage structure 126 formed in ROS 108 using fabrication techniques well known in the art.

Figure 10:
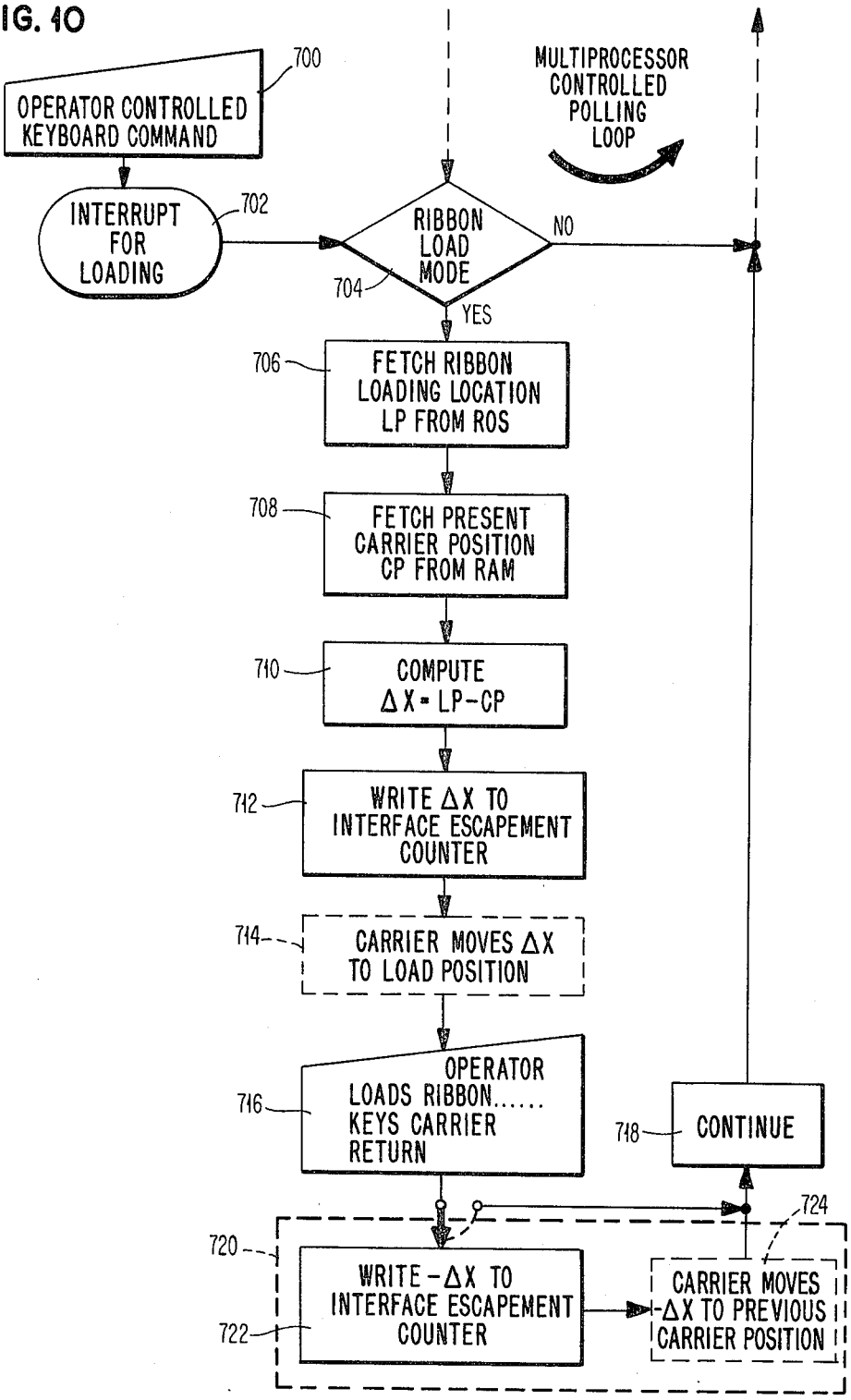
FIG. 10 is a flow chart describing ribbon loading logic.

A sequential logic procedure for controlling carrier movement to the load position according to the invention is preferably implemented as a logic defining structure 128 that is formed as a part of ROS 108. The logic defining structure 128 is described in terms of basic operations (see FIG. 10) that translate, for those skilled in the art, into the structure 128 for cooperating with the basic logic building blocks of the processor 100 (which may take various forms well known in the art).

Firstly, an operator initiated signal is generated (Block 700) by means such as the "load" switch 124 of keyboard apparatus 116. The ribbon load signal from switch 124 is buffered at the interface device 112 and is accessed by the processor 100 (Block 702). As a part of a polling loop for received signals, a test is performed to determine if a ribbon load signal has been received (Block 704). If the test is positive, the ribbon load position number LP is retrieved from storage structure 126 of ROS 108 (Block 706). The present carrier position number CP is fetched from location 121 of RAM 110 (Block 708) to permit a calculation of the number $\Delta X$ representing the shift distance that the printhead carrier 22 must move for "docking" at the ribbon load position (Block 710). After the number $\Delta X$ is defined, a corresponding coded signal is written to the interface escapement counter register 122 (Block 712) causing the printhead carrier 22 to be moved accordingly (Block 714) through the cooperation of the interface 112 and the drive 120 as was discussed above.

With the printhead carrier 22 at the ribbon loading position, a cartridge 30 may be mounted or removed (Block 716). At this point, the logic may return to normal polling operation (Block 718) requiring the operator to control movement of the printhead carrier 22 or an automatic return to the previous carrier position (Block 720) could be triggered by, for example, the load key 124 (a switch is shown to indicate this is an alternative for the logic designer). To cause a return to the previous position, a reverse direction movement command for the distance number $\Delta X$ would be written to the escapement counter register 122 of the interface 112 (Block 722). The reverse movement would then be coordinated by the interface 112 (Block 724).

Also, for a typewriter having separate switches 750 and 760 (see FIG. 9) for overall power and partial power shutoff, a partial power shutoff may be treated as a load command so that the cartridge 30 is closed and the ribbon 36 is protected when the machine is not in use.

The invention has been described with respect to a presently preferred implementation. It will, however, be appreciated that variations and modifications are possible within the spirit and scope of the invention. For example, various printheads including ball element and electrothermal printheads may be used. Also, an open ended threading frame may be provided on a single section cartridge that provides for mounting that threads the ribbon around a printhead at a mounting position located at a terminus of the carrier travel axis.

What is claimed is:

1. A ribbon system for use with a printer that includes a printhead supported on a carrier that is moveable along a carrier path between two terminal positions, one in a forward direction for printing and the other in the reverse direction for printing, said system comprising:

a cartridge that includes a length of ribbon and a cover section for generally enclosing said ribbon, there being an output side of said cover section through which a loop of said ribbon extends;

a cartridge holder that is aligned with said carrier path and located adjacent one selected terminal position thereof, said cartridge holder including means for releasably retaining said cover section with said output side facing said selected terminal position of said carrier path;

said cartridge further including a frame that is releasably attached at the output side of said cover section and includes ribbon guides that establish a path for said ribbon loop, there being a central opening defined by said frame within said ribbon loop path, which central opening is arranged relative to said cover section to permit said frame to extend onto said carrier and around said printhead when said carrier is at said selected terminal position and said frame is attached to said cover section at said cartridge holder; and means for releasing said frame from said cover section to permit said frame to move with said printhead.

2. A ribbon system according to claim 1 wherein said cartridge includes a supply and a takeup reel for said ribbon that are enclosed in said cover section, there being access openings in said cover section adjacent to said reels to permit engagement therewith, said retaining means including respective reel couplers that engage said reels, one of said couplers being connected to means that selectively transfers motion from said carrier.

3. A ribbon system according to claim 2 wherein said frame is releasably attached to said cover section by a catch that is moveable from a latching position to an inoperative position and said releasing means is a projection on said cartridge holder that displaces said catch when said cartridge is mounted on said cartridge holder.

4. A ribbon system according to claim 2 and further including:

operator actuable means for producing a ribbon load signal;

means for identifying the terminal position adjacent to said cartridge holder as a ribbon loading position; and means, responsive to said ribbon load signal, for driving said carrier to said ribbon loading position.

* * * * *